US010823475B2

(12) United States Patent
Junge et al.

(10) Patent No.: US 10,823,475 B2
(45) Date of Patent: Nov. 3, 2020

(54) CLEAR BARREL ICE MAKER

(71) Applicant: Haier US Appliance Solutions, Inc., Wilmington, DE (US)

(72) Inventors: Brent Alden Junge, Evansville, IN (US); John Keith Besore, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 75 days.

(21) Appl. No.: 16/135,110

(22) Filed: Sep. 19, 2018

(65) Prior Publication Data

US 2020/0088452 A1 Mar. 19, 2020

(51) Int. Cl.

| | |
|---|---|
| ***F25C 1/04*** | (2018.01) |
| ***F25C 1/18*** | (2006.01) |
| ***F25C 1/24*** | (2018.01) |
| ***F25C 5/20*** | (2018.01) |
| ***F25C 5/08*** | (2006.01) |

(52) U.S. Cl.

CPC ..... *F25C 1/04* (2013.01); *F25C 1/18* (2013.01); *F25C 1/24* (2013.01); *F25C 5/08* (2013.01); *F25C 5/22* (2018.01); *F25C 2700/12* (2013.01); *F25C 2700/14* (2013.01)

(58) Field of Classification Search

CPC ..... F25C 1/18; F25C 5/04; F25C 5/06; F25C 2400/18

See application file for complete search history.

(56) References Cited

U.S. PATENT DOCUMENTS

| | | | | |
|---|---|---|---|---|
| 4,059,970 | A | 11/1977 | Loeb | |
| 6,153,105 | A * | 11/2000 | Tadlock | C02F 9/005 210/167.3 |
| 6,357,720 | B1 | 3/2002 | Shapiro et al. | |
| 6,688,130 | B1 * | 2/2004 | Kim | F25C 1/08 62/352 |
| 7,263,835 | B2 * | 9/2007 | Lin | F25C 1/04 62/3.63 |
| 8,516,846 | B2 * | 8/2013 | Lee | F25C 1/08 62/349 |
| 8,522,566 | B2 * | 9/2013 | Leclear | F25C 5/187 62/137 |

(Continued)

FOREIGN PATENT DOCUMENTS

JP H0718627 B2 3/1995

*Primary Examiner* — Christopher R Zerphey

(74) *Attorney, Agent, or Firm* — Dority & Manning, P.A.

(57) ABSTRACT

An ice maker includes a mold body. A plurality of mold cavities are defined in the mold body. Each mold cavity extends between a floor and an opening along a longitudinal axis. Each mold cavity is enclosed by at least one sidewall between the floor and the opening. The longitudinal axis of each mold cavity is oriented generally along the vertical direction. The ice maker also includes a heater in thermal communication with the floor of each mold cavity of the plurality of mold cavities. The heater is configured to maintain water within a lower portion of each mold cavity in a liquid state. The ice maker further includes a drain conduit in fluid communication with the mold body and configured to receive a flow of liquid water from the mold cavities. A related refrigerator appliance and related methods are also provided.

14 Claims, 11 Drawing Sheets

(56) References Cited

U.S. PATENT DOCUMENTS

| | | | | |
|---|---|---|---|---|
| 8,844,314 | B2 * | 9/2014 | Bortoletto | F25C 1/08 62/347 |
| 9,074,802 | B2 * | 7/2015 | Culley | F25C 1/25 |
| 9,574,811 | B2 | 2/2017 | Papalia | |
| 10,274,238 | B2 * | 4/2019 | Mitchell | F25C 1/18 |
| 2009/0223230 | A1 * | 9/2009 | Kim | F25C 1/08 62/73 |

* cited by examiner

CLEAR BARREL ICE MAKER

FIELD OF THE INVENTION

The present subject matter relates generally to ice makers, and in particular to ice makers for forming clear barrel ice.

BACKGROUND OF THE INVENTION

Certain refrigerator appliances include an ice maker. An ice maker may also be a stand-alone appliance designed for use in commercial and/or residential kitchens. To produce ice, liquid water is directed to the ice maker and frozen. A variety of ice types can be produced depending upon the particular ice maker used. For example, certain ice makers include a mold body for receiving liquid water. The shape of the ice produced in such ice makers will generally correspond to the shape of the mold body. For example, refrigerator ice makers and other residential ice makers commonly include a mold body which produces crescent-shaped ice. Typical ice makers also generally produce ice which can be cloudy or opaque.

Many consumers, however, prefer barrel ice, which may be generally cylindrical in shape, over crescent-shaped ice pieces. In addition, many consumers prefer clear ice over cloudy or opaque ice. However, ice makers which make barrel ice generally do not include features for providing clear ice, whereas ice makers which make clear ice generally do not include features for providing barrel-shaped ice.

Accordingly, an ice maker with features for producing ice which is clear and barrel-shaped would be useful.

BRIEF DESCRIPTION OF THE INVENTION

Aspects and advantages of the invention will be set forth in part in the following description, or may be apparent from the description, or may be learned through practice of the invention.

In one exemplary embodiment, an ice maker is provided. The ice maker defines a vertical direction, a lateral direction, and a transverse direction. The vertical, lateral, and transverse directions are mutually perpendicular. The ice maker includes a mold body. A plurality of mold cavities are defined in the mold body. Each mold cavity of the plurality of mold cavities extends between a floor and an opening along a longitudinal axis. Each mold cavity of the plurality of mold cavities is enclosed by at least one sidewall between the floor and the opening. The longitudinal axis of each mold cavity is oriented generally along the vertical direction. The ice maker also includes a heater in thermal communication with the floor of each mold cavity of the plurality of mold cavities. The heater is configured to maintain water within a lower portion of each mold cavity in a liquid state. The ice maker further includes a drain conduit in fluid communication with the mold body and configured to receive a flow of liquid water from the mold cavities.

In another exemplary embodiment, a refrigerator appliance is provided. The refrigerator appliance includes a cabinet that defines a chilled chamber and an ice maker in thermal communication with the chilled chamber. The ice maker defines a vertical direction, a lateral direction, and a transverse direction. The vertical, lateral, and transverse directions are mutually perpendicular. The ice maker includes a mold body. A plurality of mold cavities are defined in the mold body. Each mold cavity of the plurality of mold cavities extends between a floor and an opening along a longitudinal axis. Each mold cavity of the plurality of mold cavities is enclosed by at least one sidewall between the floor and the opening. The longitudinal axis of each mold cavity is oriented generally along the vertical direction. The ice maker also includes a heater in thermal communication with the floor of each mold cavity of the plurality of mold cavities. The heater is configured to maintain water within a lower portion of each mold cavity in a liquid state. The ice maker further includes a drain conduit in fluid communication with the mold body and configured to receive a flow of liquid water from the mold cavities.

In yet another exemplary embodiment, a method of making clear ice in a refrigerator appliance is provided. The refrigerator appliance includes a cabinet defining a chilled chamber. The method includes filling a plurality of mold cavities in a mold body of an ice maker with liquid water and directing a flow of chilled air from the chilled chamber of the refrigerator towards openings of the plurality of mold cavities. As a result, the liquid water in an upper portion of each of the plurality of mold cavities freezes from the top down, such that clear ice barrels are formed. The method also includes activating a heater in the mold body of the ice maker during the step of directing the flow of chilled air. The heater is in thermal communication with a floor of each mold cavity of the plurality of mold cavities, such that the liquid water in a lower portion of each of the plurality of mold cavities is maintained in a liquid state. The method further includes draining at least a portion of the liquid water from the mold body of the ice maker with a drain conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
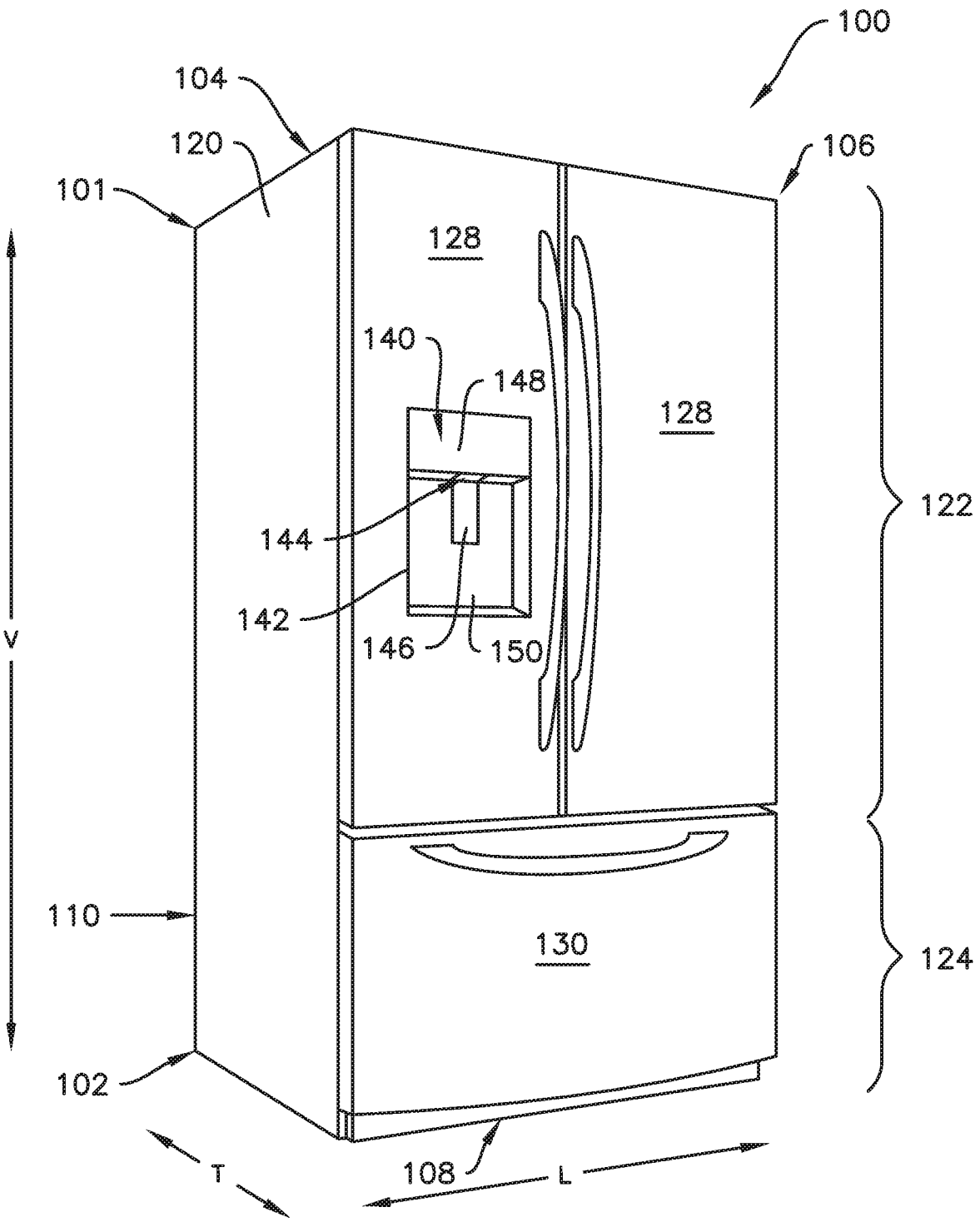
FIG. 1 provides a perspective view of a refrigerator appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 provides a perspective view of a refrigerator appliance 100 according to an exemplary embodiment of the present subject matter. Refrigerator appliance 100 includes a cabinet or housing 120 that generally defines a vertical direction V, a lateral direction L, and a transverse direction T, each of which is mutually perpendicular, such that an orthogonal coordinate system is generally defined. The cabinet 120 extends between a top 101 and a bottom 102 along the vertical direction V, between a left side 104 and a right side 106 along the lateral direction L, and between a front 108 and a rear 110 along the transverse direction T. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance or a standalone ice maker appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122, e.g., at the left side 104 and the right side 106. In addition, a freezer door 130 is arranged below refrigerator doors 128 for selectively accessing freezer chamber 124. Freezer door 130 is coupled to a freezer drawer (not shown) mounted within freezer chamber 124 and slidable along the transverse direction T. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and/or liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
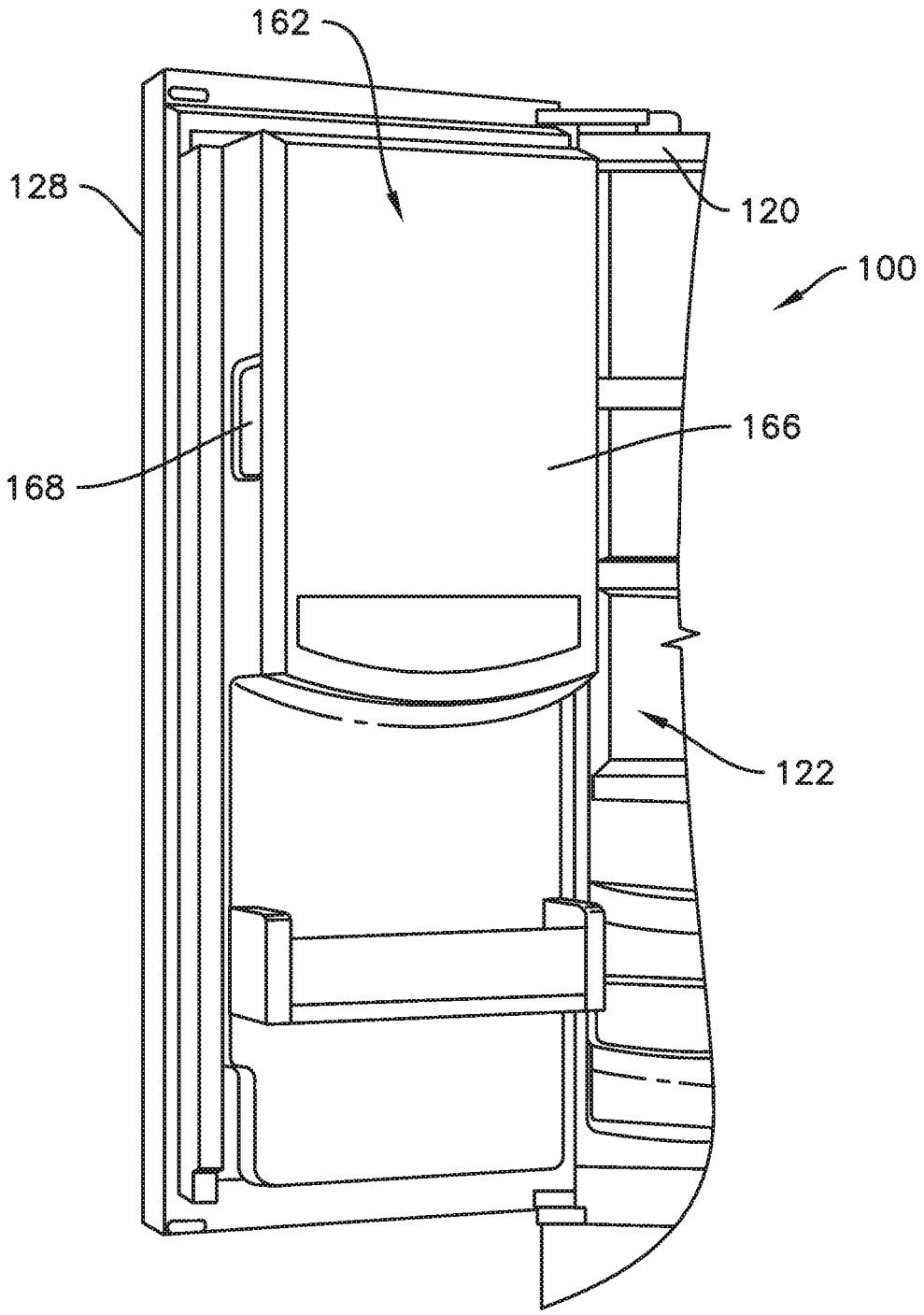
FIG. 2 provides a perspective view of a door of the exemplary refrigerator appliance of FIG. 1.
Figure 3:
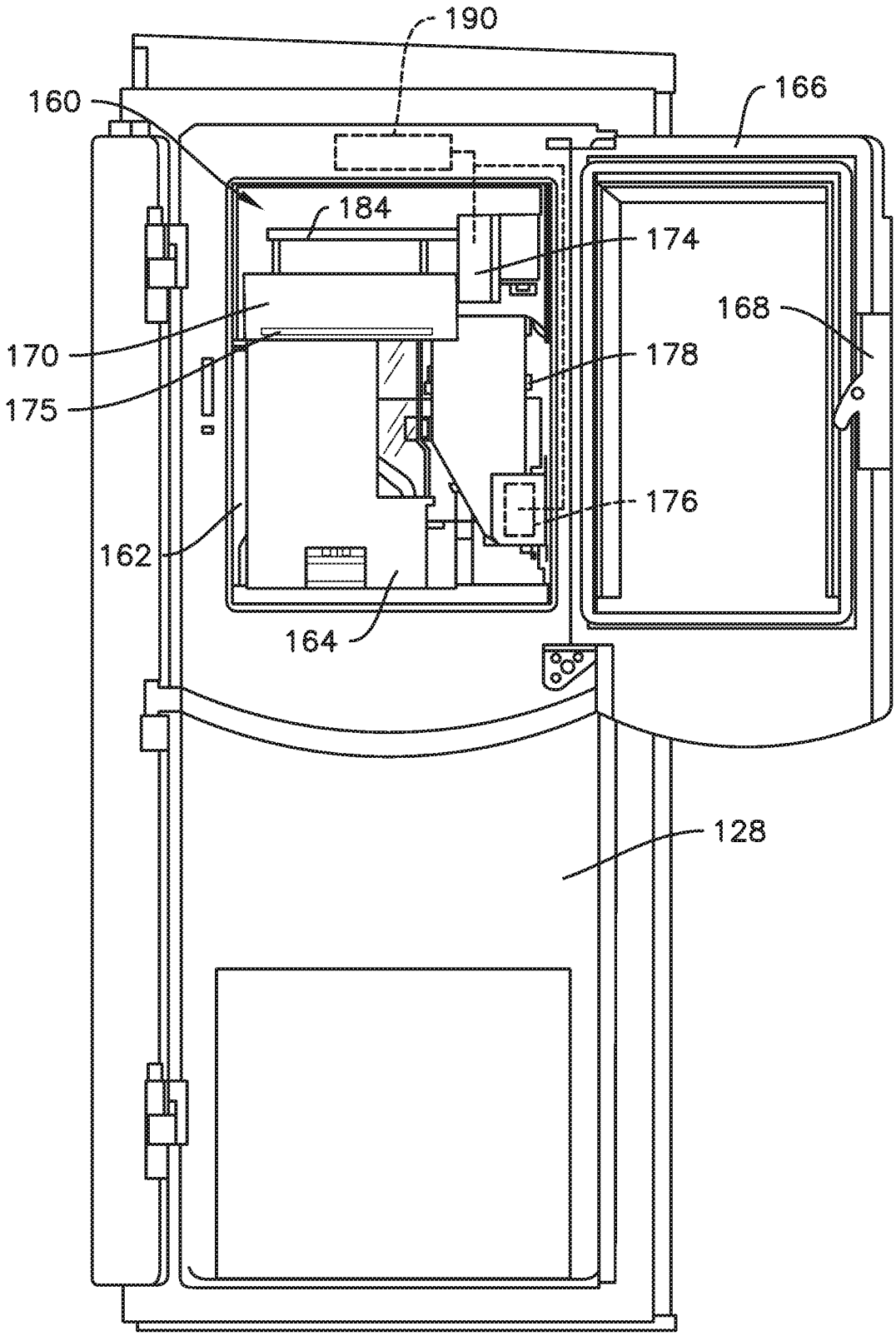
FIG. 3 provides an elevation view of the door of the exemplary refrigerator appliance of FIG. 2 with an access door of the door shown in an open position.

FIG. 2 provides a perspective view of a door of refrigerator doors 128. Refrigerator appliance 100 includes a sub-compartment 162 defined on refrigerator door 128. Sub-compartment 162 may be referred to as an "icebox." Sub-compartment 162 extends into fresh food chamber 122 when refrigerator door 128 is in the closed position. As shown in FIG. 3 and discussed in greater detail below, an ice maker or ice making assembly 160 and an ice storage bin 164 may be positioned or disposed within sub-compartment 162. Thus, ice is supplied to dispenser recess 150 (FIG. 1) from the ice maker 160 and/or ice storage bin 164 in sub-compartment 162 on a back side of refrigerator door 128. Chilled air from a sealed system (not shown) of refrigerator appliance 100 may be directed into components within sub-compartment 162, e.g., ice maker 160 and/or ice storage bin 164. As mentioned above, the present disclosure may also be applied to other types and styles of refrigerator appliances such as, e.g., a top mount refrigerator appliance, a side-by-side style refrigerator appliance or a standalone ice maker appliance. Accordingly, the description herein of the icebox 162 on the door 128 of the fresh food chamber 122 is by way of example only. In other example embodiments, the ice maker 160 may be positioned in the freezer chamber 124, e.g., of the illustrated bottom-mount refrigerator, a side by side refrigerator, a top-mount refrigerator, or any other suitable refrigerator appliance. As another example, the ice maker 160 may also be provided in a standalone icemaker appliance.

An access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162, e.g., by thermally isolating or insulating sub-compartment 162 from fresh food chamber 122.

FIG. 3 provides an elevation view of refrigerator door 128 with access door 166 shown in an open position. As may be seen in FIG. 3, ice maker 160 is positioned or disposed within sub-compartment 162. Ice maker 160 includes a mold body or casing 170. As described in more detail below, a motor 174 is mounted within sub-compartment 162, and is in mechanical communication with (e.g., coupled to) an ejector assembly for ejecting ice from the mold body 170. An ice bucket or ice storage bin 164 is positioned proximate the mold body 170 and receives the ice after the ice is ejected from the mold body 170. From ice storage bin 164, the ice can enter dispensing assembly 140 and be accessed by a user as discussed above. In such a manner, ice maker 160 can produce or generate ice.

Ice maker 160 also includes a fan 176. Fan 176 is configured for directing a flow of chilled air towards mold body 170. As an example, fan 176 can direct chilled air from an evaporator of a sealed system through a duct to mold body 170. Thus, mold body 170 can be cooled with chilled air from fan 176 such that ice maker 160 is air cooled in order to form ice therein. In some embodiments, e.g., as illustrated in FIG. 3, the fan 176 may be located within the sub-compartment 162. In other embodiments, the location of the fan 176 may vary, for example, the fan 176 may be located in a mechanical compartment with the sealed system, e.g., proximate to the evaporator. Ice maker 160 also includes a harvest heater 175, such as an electric resistance heating element, mounted to or otherwise in thermal communication with mold body 170. Harvest heater 175 is configured for selectively heating mold body 170, e.g., to assist in ejecting ice from the mold body 170.

Operation of ice maker 160 is controlled by a processing device or controller 190, e.g., that may be operatively coupled to control panel 148 for user manipulation to select features and operations of ice maker 160. Controller 190 can operate various components of ice maker 160 to execute selected system cycles and features. For example, controller 190 is in operative communication with motor 174, fan 176 and heater 175. Thus, controller 190 can selectively activate and operate motor 174, fan 176 and heater 175.

Controller 190 may include a memory and microprocessor, such as a general or special purpose microprocessor operable to execute programming instructions or micro-control code associated with operation of ice maker 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 175 may be in communication with controller 190 via one or more signal lines or shared communication busses. It should be noted that controllers 210 as disclosed herein are capable of and may be operable to perform any methods and associated method steps as disclosed herein.

Ice maker 160 also includes a temperature sensor 178. Temperature sensor 178 is configured for measuring a temperature of mold body 170 and/or liquids, such as liquid water, within mold body 170. Temperature sensor 178 can be any suitable device for measuring the temperature of mold body 170 and/or liquids therein. For example, temperature sensor 178 may be a thermistor or a thermocouple or a bimetal thermostat. Controller 190 can receive a signal, such as a voltage or a current, from temperature sensor 190 that corresponds to the temperature of the mold body 170 and/or liquids therein. In such a manner, the temperature of mold body 170 and/or liquids therein can be monitored and/or recorded with controller 190. Some embodiments can also include an electromechanical icemaker configured with a bimetal thermostat to complete an electrical circuit when a specific temperature is reached. By completion of the circuit, the heater 175 and ejector mechanism would be activated via electrical powering of the motor 174.

Figure 4:
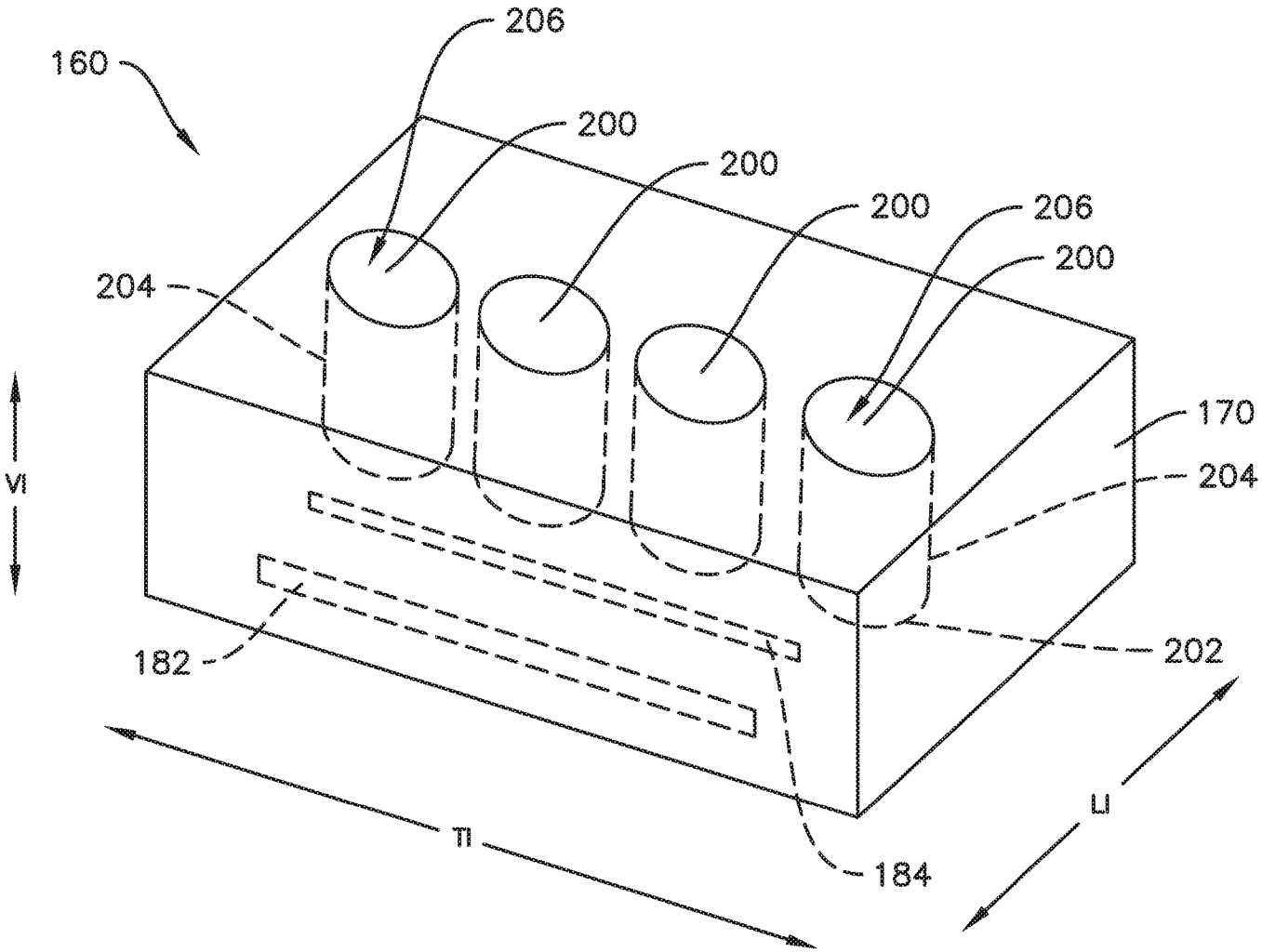
FIG. 4 provides a perspective view of an ice maker according to one or more exemplary embodiments of the present subject matter.

FIG. 4 provides a perspective view of the ice maker 160. The ice maker 160 defines a vertical direction VI, a lateral direction LI, and a transverse direction TI. In exemplary embodiments wherein the ice maker 160 is installed in a refrigerator appliance 100, the ice maker 160 may be installed such that the vertical direction VI of the ice maker 160 generally corresponds to the vertical direction V of the cabinet 120. As noted above, terms of approximation such as "generally" or "about" are used herein to include within ten percent greater or less than the stated value. In the context of an angle or direction, such terms include within ten degrees greater or less than the stated angle or direction. For example, the ice maker 160 may be installed such that the vertical direction VI of the ice maker 160 generally corresponds to the vertical direction V of the cabinet 120 when the vertical direction VI is aligned with, or within ten degrees in any direction of, the vertical direction V.

Figure 5:
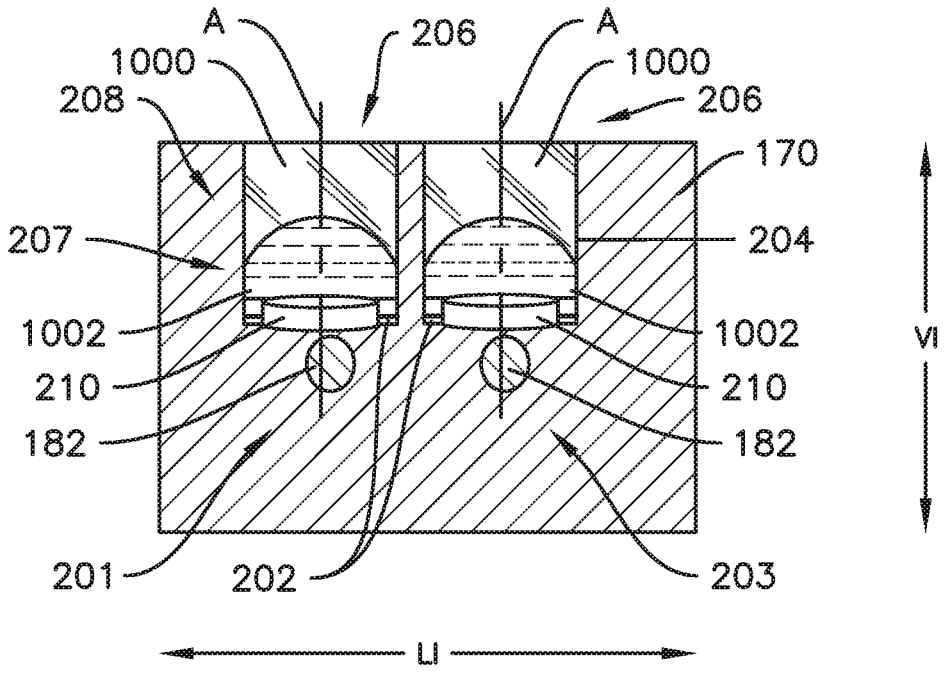
FIG. 5 provides a sectional view of the ice maker of FIG. 4.

As may be seen in FIG. 4, the mold body 170 of ice maker 160 includes a plurality of mold cavities 200 defined in the mold body 170 for forming ice 1000 therein. In the example illustrated by FIG. 4, the mold body 170 includes a single row of four mold cavities 200. In other embodiments, more or fewer mold cavities 200 may be included, such as in multiple rows. For example, as shown in FIG. 5, the plurality of mold cavities 200 may include a first row 201 of mold cavities 200 extending generally along the transverse direction TI and a second row 203 of mold cavities 200 extending generally along the transverse direction TI and spaced apart from the first row 203 along the lateral direction LI. In various embodiments, the first and second rows 201 and 203 may each include four mold cavities 200, as shown in FIG. 4, or may include any suitable number of mold cavities 200. For example, one or both of the first and second rows 201 and 203 may include three or fewer mold cavities 200. In other embodiments, one or both of the first and second rows 201 and 203 may include more than four mold cavities 200. The first and second rows 201 and 203 may include different numbers of mold cavities 200, e.g., one of the first and second rows 201 and 203 may include three mold cavities 200 while the other of the first and second rows 201 and 203 may include four mold cavities 200, as well as various other combinations of numbers of mold cavities 200.

The mold cavities 200 may be configured to receive liquid water to form ice 1000 in each mold cavity 200. As will be understood, the shape of ice 1000 formed in the mold cavities 200 will correspond to the shape of the mold cavity 200. The mold cavities 200 may be generally cylindrical. Accordingly, generally cylindrical ice, sometimes referred to as "barrel ice," may be produced by the ice maker 160, e.g., the ice 1000 may be ice barrels 1000. Example embodiments of the generally cylindrical mold cavity 200 may include tapered sidewalls, e.g., forming an angle of up to ten degrees with a floor 202 of the mold cavity 200, convex sidewalls, and/or concave sidewalls. In some embodiments, the generally cylindrical mold cavity 200 may have any suitable cross-sectional shape, e.g., hexagonal, instead of a round, e.g., circular or oval, cross-section.

As may be seen in FIG. 4, each mold cavity 200 is enclosed between the floor 202 and the opening 206 by at least one sidewall 204. For example, in the illustrated embodiments, the sidewall 204 is generally cylindrical. As noted above, in other embodiments, the mold cavities 200 may be, e.g., hexagonal, and thus may include more than one, e.g., six, sidewalls 204 enclosing each mold cavity 200 between the floor 202 and the opening 204.

As may be seen in FIGS. 4 and 5, the ice maker 160 may include a heater 182 in thermal communication with the floor 202 of each mold cavity 200 of the plurality of mold cavities 200. In some embodiments, a heat pipe 184 (FIG. 4) may be provided to promote even distribution of thermal energy, e.g., heat, from the heater 182 to each of the mold cavities 200. Each of the mold cavities 200 extends between a floor 202 and an opening 206 along a longitudinal axis A (FIG. 5). The longitudinal axis A of each mold cavity 200 is oriented generally along the vertical direction VI of the ice maker 160, and may in some embodiments also be generally aligned with the vertical direction V of the refrigerator appliance 100.

Still referring to FIGS. 4 and 5, the opening 206 is exposed to a flow of chilled air, e.g., cool or cold air, where "cool" or "cold" refers to air having a sufficiently low temperature to freeze water in the mold cavities 200, such as a temperature less than about thirty-two degrees Fahrenheit (32° F.), thereby forming ice 1000 in the mold cavities. For example, the chilled air may have a temperature of between about zero degrees Fahrenheit (0° F.) and about twenty-five degrees Fahrenheit (25° F.). For example, the chilled air flow may be directed to or towards the openings 206 by the fan 176 (FIG. 3), as described above. The heater 182 is positioned proximate to the floor 202 of each mold cavity 200 such that the heating element(s) heat water at the floor 202 of each mold cavity 200. As shown in FIG. 5, each mold cavity may include a lower portion 207 and an upper portion 208. For example, the lower portion 207 may comprise about half of the mold cavity 200, from the floor 202 to a midpoint between the floor 202 and the opening 206, and the upper portion 208 may comprise about half of the mold cavity 200, from the midpoint to the opening 206. The heater 182 may be configured to maintain water within the lower portion 207 of each mold cavity 200 in a liquid state. Thus, in operation, ice 1000 may be formed within the mold cavities 200 from the top down, from the opening 206 due to contact with the cool or cold air, towards the floor 202, where the water in the mold cavity 200 will remain liquid due to the heater 182. For example, as shown in FIG. 5, ice 1000 may form in the upper portion 208 of the mold cavity 200, while liquid water remains in the lower portion 207. The remaining liquid, unfrozen water may also be referred to as ballast water.

Forming the ice 1000 in one direction, e.g., from the top down as described above, results in formation of clear ice. In particular, as the ice is forming, e.g., when the water is slightly above the freezing point, such as about 5 or 6 degrees above freezing, the water in the mold cavities 200, in particular the portion of the water which is exposed to the cold air, e.g., at the openings 206 of the mold cavities 200, will start to expand as it solidifies and then float at or towards the top, e.g., the opening 206, of each mold cavity 200. During this process, any impurities, e.g., dissolved solids and/or suspended solids, which may be present in the water tend to be forced downwards. As a result, the ice 1000 is more pure or cleaner and the ballast water is dirtier.

The ice maker 160 may include an ejector assembly for removing the ice barrels 1000 from the mold body 170, for example as shown in FIG. 5, the ejector assembly may include a plurality of ejector pads 210. The plurality of ejector pads 210 may correspond to the plurality of mold cavities 200, e.g., the plurality of ejector pads 210 may include a number of ejector pads 210 corresponding to the number of mold cavities 200. For example, in embodiments where the mold body 170 includes six mold cavities 200, the ejector assembly may include six ejector pads 210. Each ejector pad 210 is located within a corresponding mold cavity 200.

The plurality of ejector pads 210 may be movable between a low position (e.g., as shown in FIGS. 5 through 12) proximate the floor 202 and a high position proximate the opening 206 (not shown). Accordingly, when ice 1000 is formed within one or more of the mold cavities 200, moving the corresponding ejector pads 210 of each of the respective mold cavities 200 from the low position to the high position may eject the ice 1000 from the respective mold cavities 200. In various embodiments, the motor 174 may be in operative communication with the ejector assembly, such that the motor 174 is operable to move the plurality of ejector pads 210 generally along the vertical direction VI between the low position and the high position.

Figure 6:
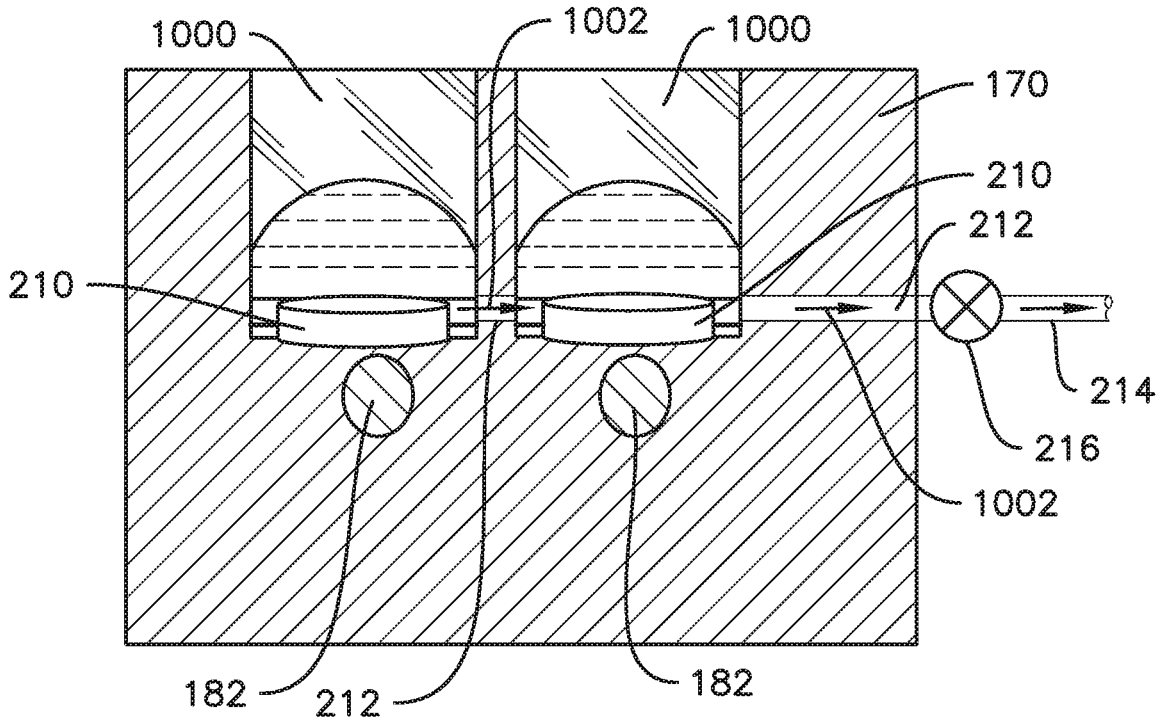
FIG. 6 provides a sectional view of the ice maker of FIG. 4 with a drain assembly according to one or more exemplary embodiments of the present subject matter.

When the ice 1000 is harvested, e.g., ejected, from the mold cavities 200, the liquid water, e.g., ballast water, in the lower portion 207 of each mold cavity 200, e.g., proximate the floor 202, is also ejected and must be managed, e.g., to avoid undesired ice formation on and around the mold body 170 other than in the mold cavities 200. Accordingly, a drain conduit 214 may be provided, e.g., as shown in FIG. 6. The drain conduit 214 may be in fluid communication with the mold body 170 and may be configured to receive a flow of liquid water 1002 from the mold body 170, e.g., from the mold cavities 200 therein.

Figure 7:
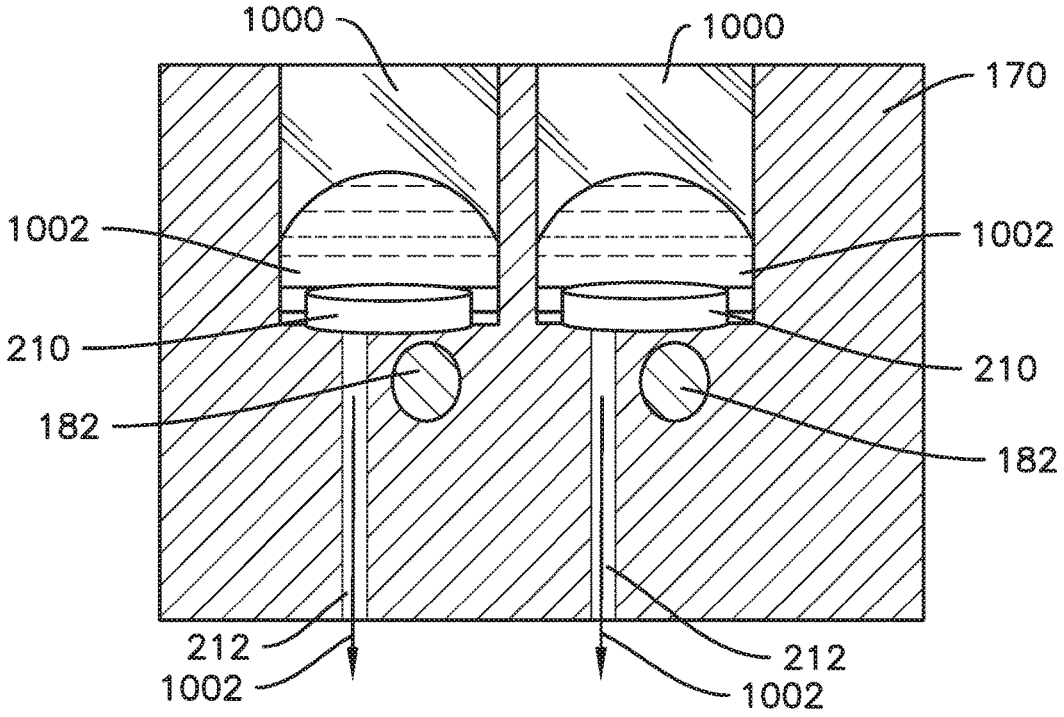
FIG. 7 provides a sectional view of the ice maker of FIG. 4 with a drain assembly according to one or more additional exemplary embodiments of the present subject matter.

For example, as shown in FIGS. 6 and 7, the drain conduit 214 may be in fluid communication with the lower portions 207 of the mold cavities 200 and configured to receive the liquid water 1002 from the lower portions 207 of the mold cavities 200, e.g., during harvest of the ice 1000. In some embodiments, e.g., as illustrated in FIGS. 6 and 7, the mold body 170 may include a plurality of passages 212. Each passage 212 of the plurality of passages 212 may extend between the lower portion 207 of a respective one of the mold cavities 200 and the drain conduit 214.

More particularly, in the example embodiment illustrated in FIG. 6, one of the plurality of passages 212 may extend between the lower portion 207 of a mold cavity 200 in the first row 201 and the drain conduit 214, e.g., from the lower portion 207 of the mold cavity 200 in the first row 201 to the lower portion 207 of a neighboring mold cavity 200 in the second row 203, and another of the plurality of passages 212 may extend between the lower portion 207 of the neighboring mold cavity 200 in the second row 203 and the drain conduit 214, e.g., from the lower portion 207 of the neighboring mold cavity 200 in the second row 203 to the drain conduit 214. In such embodiments, each of the passages 212 may extend generally along the lateral direction LI of the ice maker 160. Some such embodiments may further include a valve 216 between the plurality of passages 212 and the drain conduit 214, e.g., the plurality of passages 212 of the mold body 170 may be coupled to the drain conduit 214 via the valve 216, as illustrated for example in FIG. 6. In embodiments where the valve 216 is provided, the valve 216 may be actuated, e.g., by the motor 170, when the ice 1000 is harvested, thereby draining the ballast water 1002 during harvest.

In some embodiments, such as the example embodiment illustrated in FIG. 7, the plurality of passages 212 may extend generally along the vertical direction VI of the ice maker 160. In such embodiments, the ballast water 1002, e.g., the water which remains in the liquid state in the lower portion 207 of each mold cavity 200 due to the thermal energy from the heater 182, may flow out of each mold cavity 200 by gravity. In such embodiments, for example as illustrated in FIG. 7, each passage 212 may extend directly from a corresponding mold cavity 200 to an external surface of the mold body 170. During ice formation, the passages 212 may be obstructed by the ejector pads 210 in each mold cavity 200, e.g., where the ejector pads 210 are in the low position during ice formation. When the ejector pads 210 are raised, e.g., moved to the high position, during harvest each ejector pad 210 will be spaced apart from the corresponding passage 212 of the plurality of passages 212, such that the ballast water 1002 may flow out of the respective mold cavity 200 during harvest.

Figure 8:
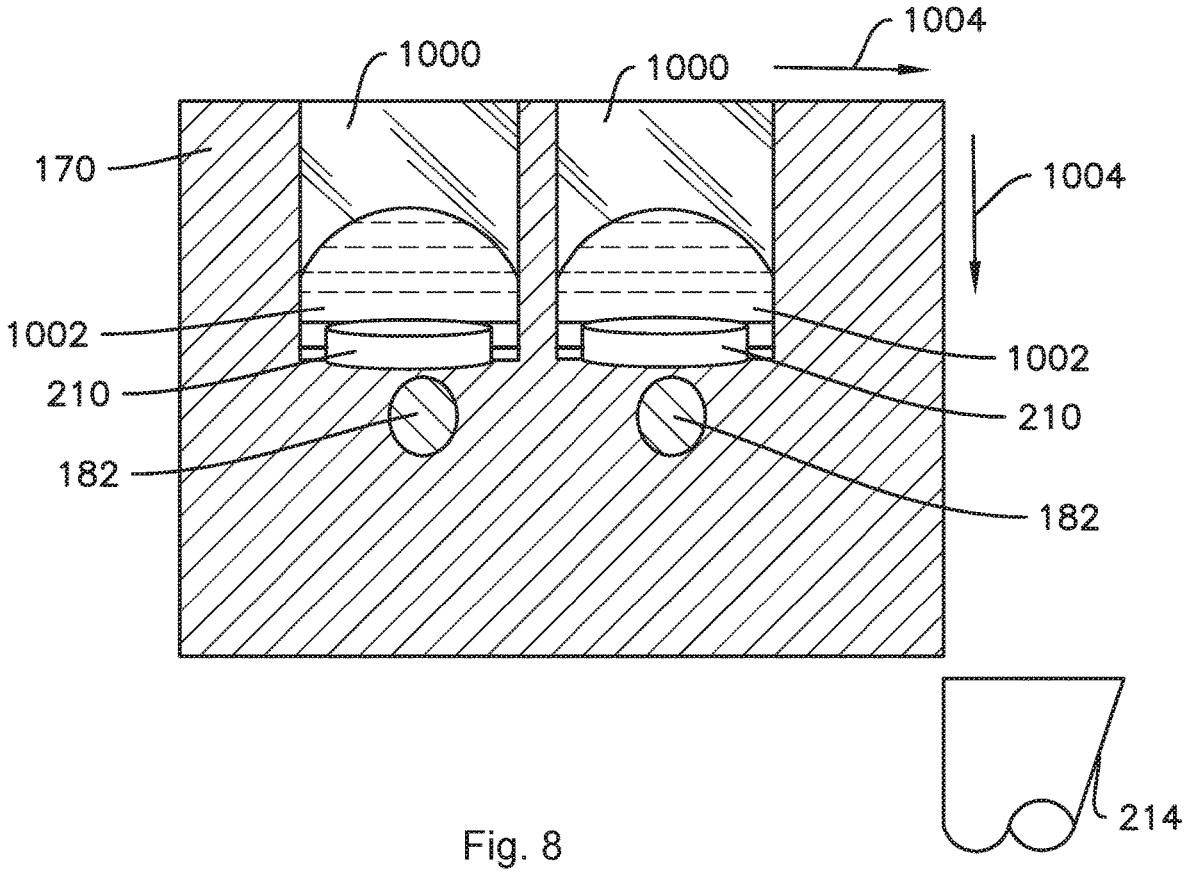
FIG. 8 provides a sectional view of the ice maker of FIG. 4 with a drain assembly according to one or more further exemplary embodiments of the present subject matter.

In some embodiments, as illustrated in FIG. 8, excess liquid water 1004 may be added to each of the mold cavities 200 during the fill process, e.g., when the mold cavities 200 are filled with liquid water after a harvest. This excess water 1004 may then flow out of the mold cavities 200, as shown, and may thereby serve to dilute the ballast water 1002, e.g., by removing at least some of the impurities from the liquid water in each mold cavity 200 to promote formation of clear ice 1000. In such embodiments, the drain conduit 214 may be disposed adjacent to the mold body 170, e.g., just below the mold body 170 along the vertical direction V and/or VI. Further, the mold body 170, such as a top surface thereof, may be slanted towards the drain conduit 214 to promote the flow of the excess water 1004 to or towards the drain conduit 214. Also in such embodiments, the drain conduit 214 may include an enlarged inlet such as a funnel-shaped inlet to promote capture of the overflowing excess water 1004 from the mold body 170.

Figure 9:
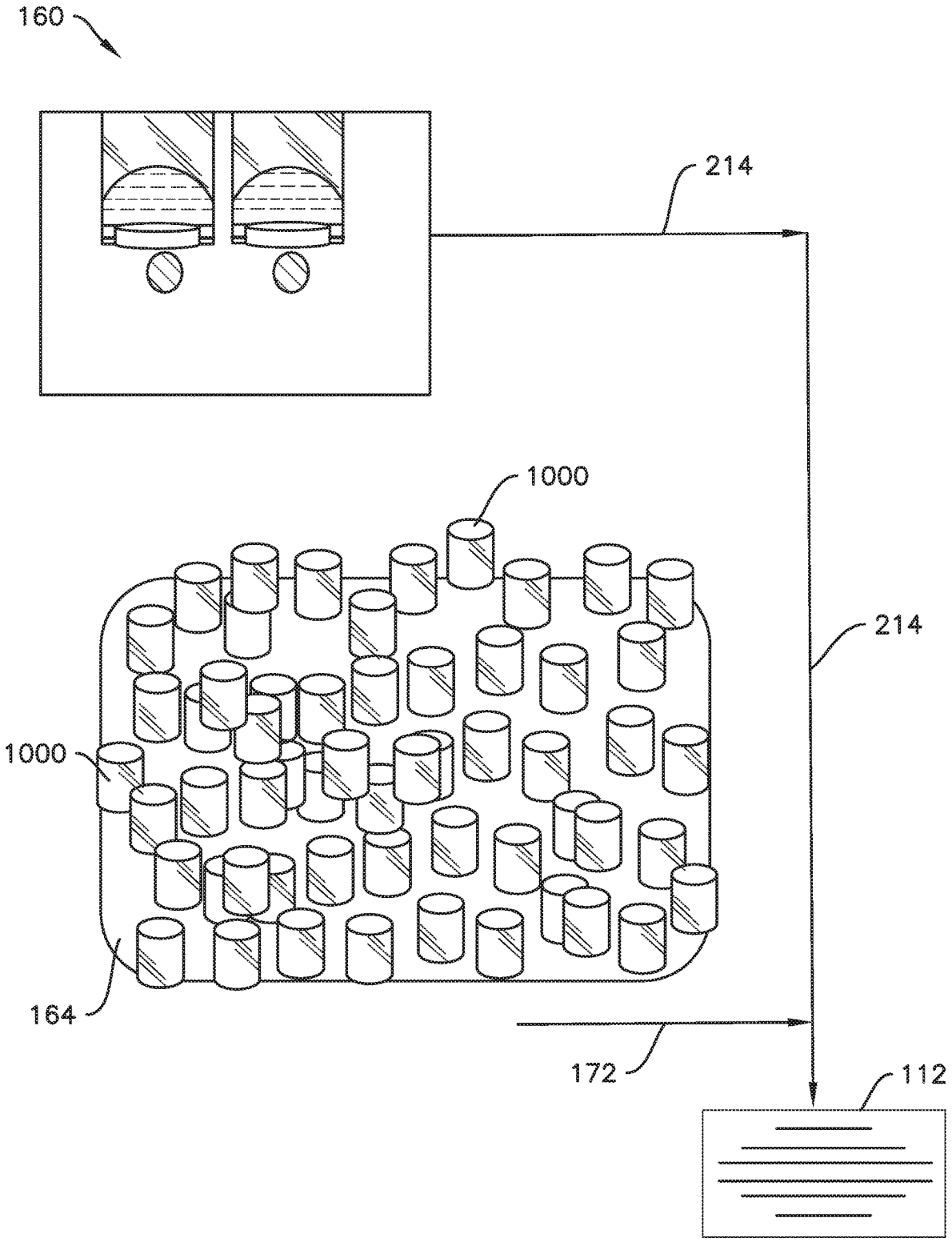
FIG. 9 provides a schematic view of an ice maker according to one or more exemplary embodiments of the present subject matter.

Turning now to FIG. 9, in some embodiments, the drain conduit 214 may be further in fluid communication with a drain pan 112 of the refrigerator appliance 100. For example, the drain pan 112 may be shallow, providing a large surface area for evaporation of water collected therein. In such embodiments, as shown in FIG. 9, the drain conduit 214 may be configured to direct the received flow of liquid water 1002 and/or 1004 from the mold cavities 200 to the drain pan 112. The drain pan 112 may also be configured to receive, e.g., condensation from various portions of the refrigerator appliance 100 and/or melt water from the ice storage bin 164. For example, the ice storage bin 164 may be connected to a drain 172 providing fluid communication between the ice storage bin 164 and the drain pan 112 for melt water from the ice storage bin 164.

Figure 10:
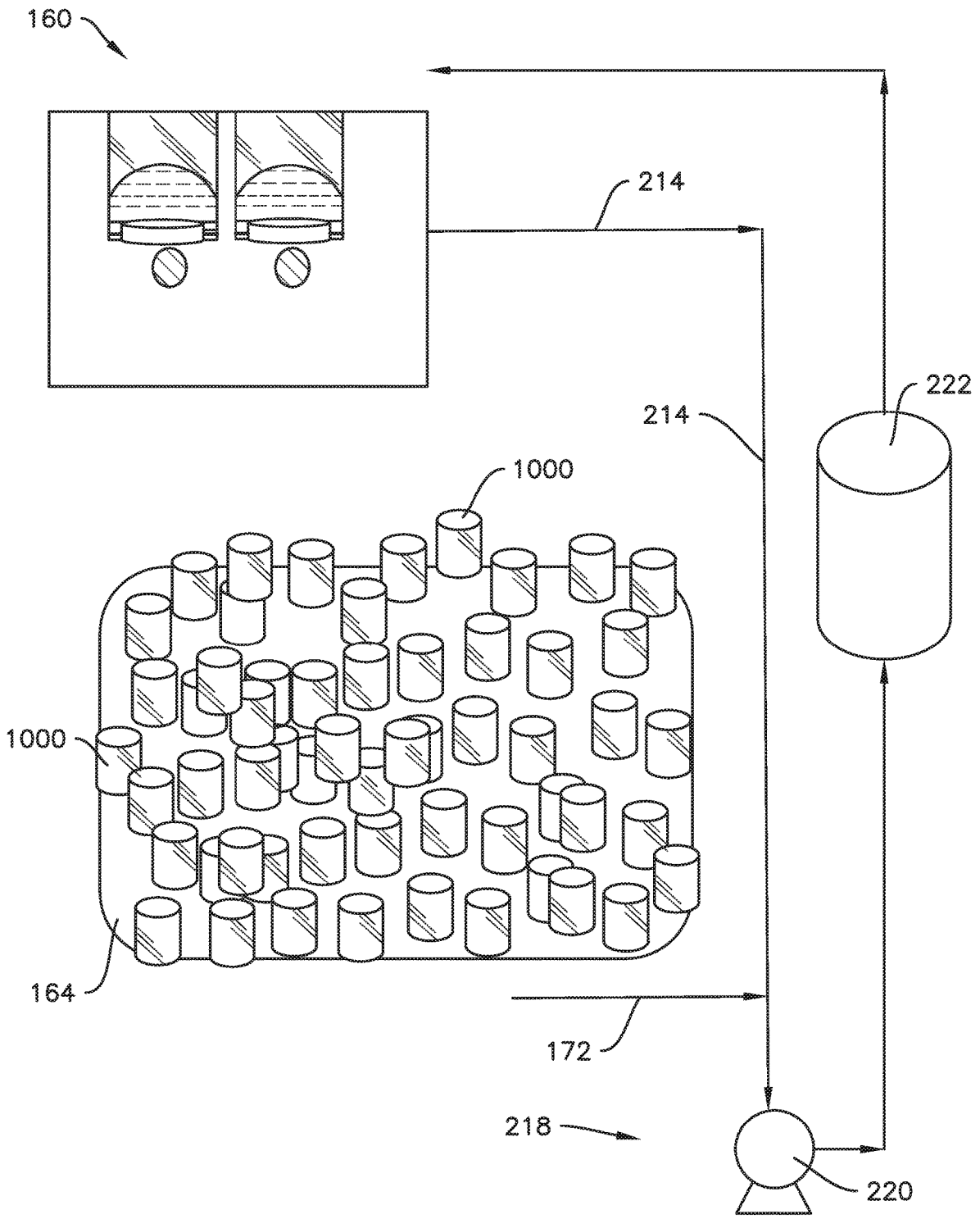
FIG. 10 provides a schematic view of an ice maker according to one or more additional exemplary embodiments of the present subject matter.

In some embodiments, as shown in FIG. 10, the drain conduit 214 may be further in fluid communication with a recirculation assembly 218. The recirculation assembly 218 may include a recirculation pump 220 and a filter 222 downstream from the recirculation pump 220 and upstream of the mold cavities 200. The recirculation pump 220 may be configured to urge liquid water from the drain conduit 214 to the mold cavities 200 via the filter 222. Accordingly, impurities which may be concentrated in the ballast water 1002 and/or the overflow water 1004 may be removed by the filter 222 before the water is returned to the mold cavities 200, promoting formation of clear ice 1000 within the mold cavities 200. In some embodiments, the filter 222 may be an ion-exchange filter. In other embodiments, any suitable filter may be provided, such as a membrane filter or a carbon filter.

Figure 11:
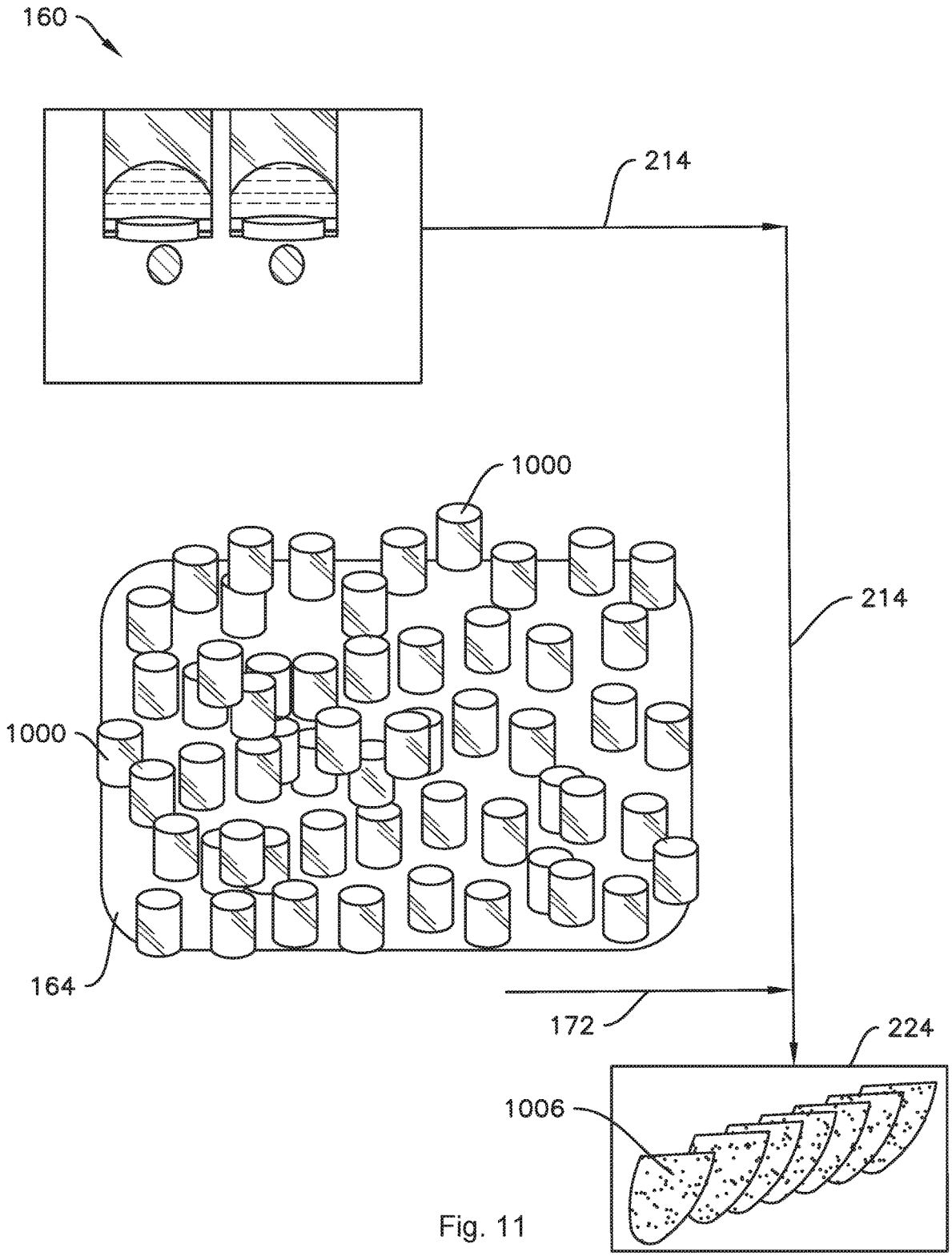
FIG. 11 provides a schematic view of an ice maker according to one or more further exemplary embodiments of the present subject matter.

In some embodiments, as shown in FIG. 11, the drain conduit 214 may be further in fluid communication with an auxiliary ice maker 224. Regular cloudy ice 1006 may be formed in the auxiliary ice maker 224. In some instances, the auxiliary ice maker 224 may be useful for providing faster ice production as opposed to the clear ice barrels 1000 formed in the ice maker 160. For example, the auxiliary ice maker 224 may have a greater capacity, e.g., a higher number of mold cavities for forming ice, than the clear ice maker 160. The cloudy ice 1006 may be used, e.g., to fill a cooler or for first-aid purposes, preserving the clear ice barrels 1000 for use, e.g., in beverages.

Figure 12:
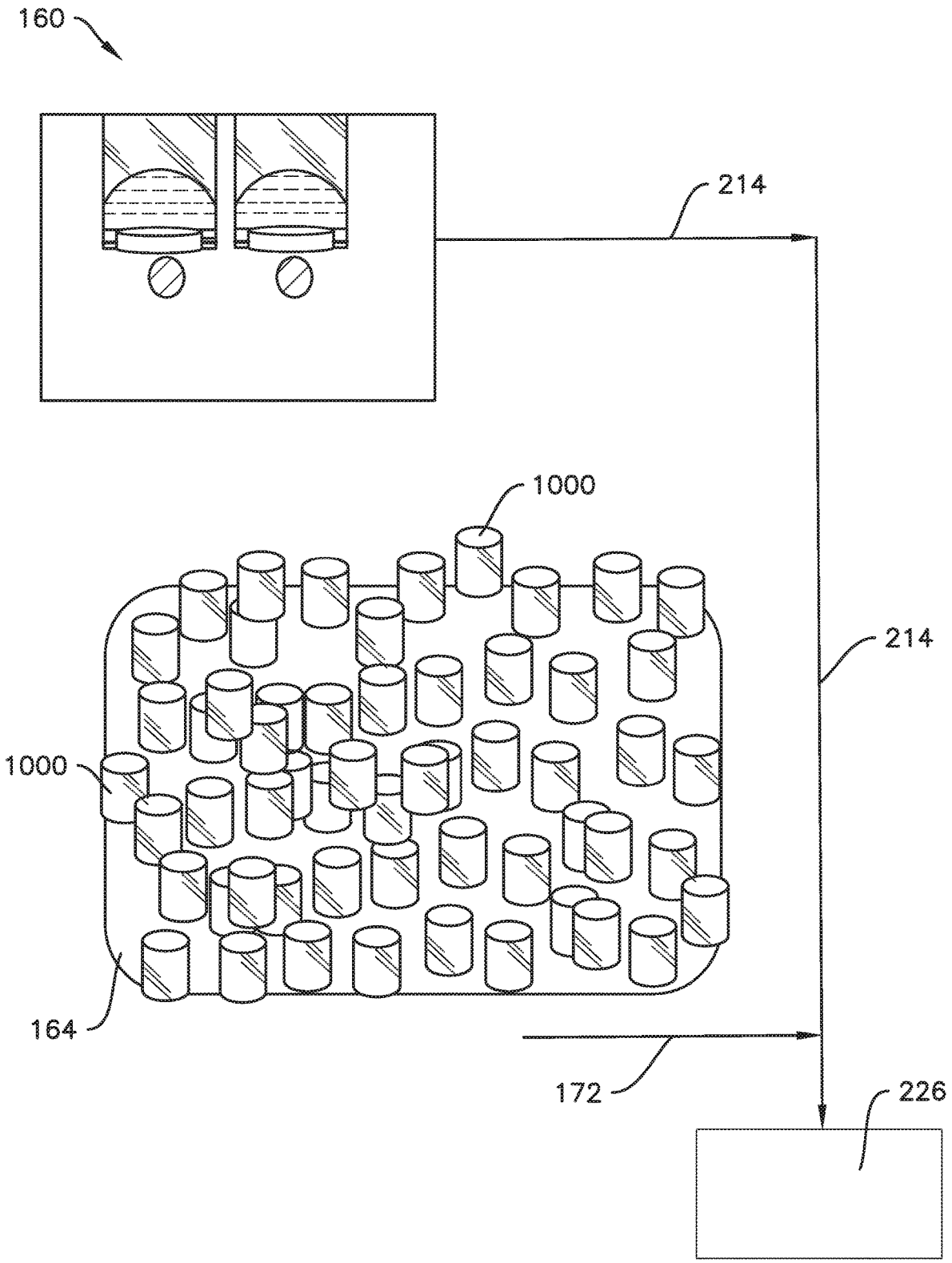
FIG. 12 provides a schematic view of an ice maker according to one or more still further exemplary embodiments of the present subject matter.

In some embodiments, as shown in FIG. 12, the drain conduit 214 may be further in fluid communication with a sump 226. The drain conduit 214 may be configured to direct the received flow of liquid water 1002 and/or 1004 from the mold cavities 200 to the sump 226. Water stored in the sump 226 may be removed by evaporation or dispersed using an ultrasonic device. The sump 226 may also include a plumbed drain, e.g., connected to a household plumbing system, for removal of water from the sump 226 by pressure and/or gravity flow.

Figure 13:
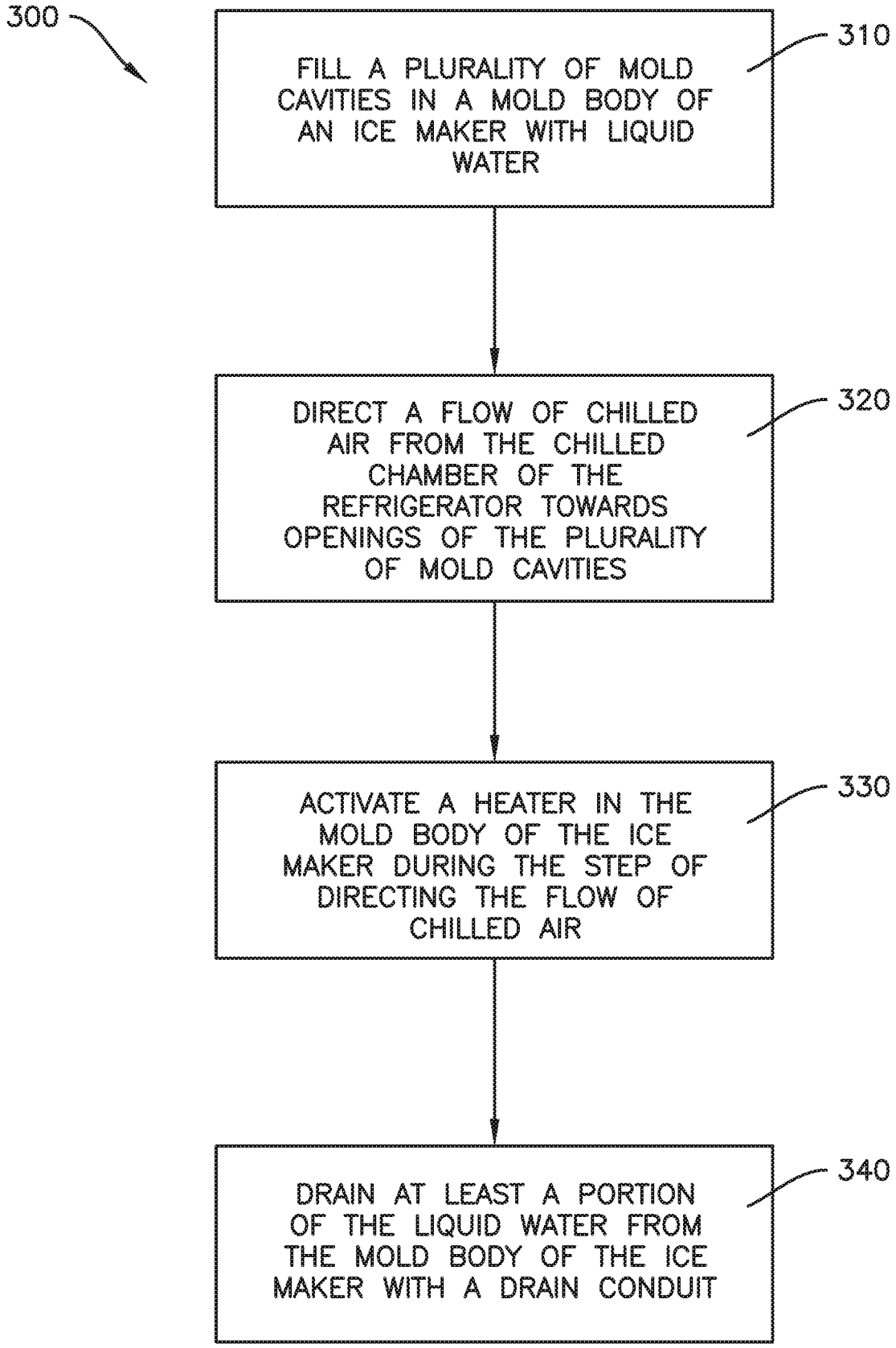
FIG. 13 provides a flow chart illustrating an exemplary method of making clear ice in a refrigerator appliance according to one or more exemplary embodiments of the present subject matter.

Turning now to FIG. 13, embodiments of the present disclosure may also include a method of making clear ice in a refrigerator appliance, such as the exemplary method 300 illustrated in FIG. 13. As illustrated in FIG. 13, the method 300 may include a step 310 of filling a plurality of mold cavities in a mold body of an ice maker with liquid water. The method 300 may further include a step 320 of directing a flow of chilled air from the chilled chamber of the refrigerator towards openings of the plurality of mold cavities. As a result of the flow of chilled air, the liquid water in an upper portion of each of the plurality of mold cavities may freeze from the top down, such that clear ice barrels are formed in the plurality of mold cavities.

The method 300 may also include a step 330 of activating a heater in the mold body of the ice maker during the step 320 of directing the flow of chilled air. The heater may be in thermal communication with a floor of each mold cavity of the plurality of mold cavities, such that the liquid water in a lower portion of each of the plurality of mold cavities is maintained in a liquid state due to thermal energy received from the heater. The method 300 may further include a step 340 of draining at least a portion of the liquid water from the mold body of the ice maker with a drain conduit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker defining a vertical direction, a lateral direction, and a transverse direction, the vertical, lateral, and transverse directions being mutually perpendicular, the ice maker comprising:

a mold body, a plurality of mold cavities defined in the mold body, each mold cavity of the plurality of mold cavities extending between a floor and an opening along a longitudinal axis, each mold cavity of the plurality of mold cavities enclosed by at least one sidewall between the floor and the opening, the longitudinal axis of each mold cavity oriented generally along the vertical direction;

a plurality of ejector pads in the plurality of mold cavities, each ejector pad of the plurality of ejector pads movable between a low position and a high position;

a heater in thermal communication with the floor of each mold cavity of the plurality of mold cavities, the heater configured to maintain water within a lower portion of each mold cavity in a liquid state; and a drain conduit in fluid communication with the lower portions of the mold cavities and configured to receive the water in the liquid state from the lower portions of the mold cavities;

wherein the mold body comprises a plurality of passages, each passage of the plurality of passages extending between the lower portion of a respective one of the mold cavities and the drain conduit, and wherein each ejector pad obstructs the corresponding passage of the plurality of passages when in the low position, and wherein each ejector pad is spaced apart from the corresponding passage of the plurality of passages when in the high position.

2. The ice maker of claim 1, wherein the drain conduit is further in fluid communication with a drain pan and the drain conduit is configured to direct the received flow of liquid water from the mold cavities to the drain pan.

3. The ice maker of claim 1, wherein the drain conduit is further in fluid communication with a recirculation assembly, the recirculation assembly comprising a recirculation pump and a filter downstream from the recirculation pump and upstream of the mold cavities, and wherein the recirculation pump is configured to urge liquid water from the drain conduit to the mold cavities via the filter.

4. The ice maker of claim 1, wherein the drain conduit is further in fluid communication with an auxiliary ice maker.

5. The ice maker of claim 1, wherein the drain conduit is further in fluid communication with a sump and the drain conduit is configured to direct the received flow of liquid water from the mold cavities to the sump.

6. The ice maker of claim 1, wherein the plurality of passages of the mold body are coupled to the drain conduit via a valve.

7. A refrigerator appliance comprising:

a cabinet defining a chilled chamber;

an ice maker in thermal communication with the chilled chamber, the ice maker defining a vertical direction, a lateral direction, and a transverse direction, the vertical, lateral, and transverse directions being mutually perpendicular, the ice maker comprising:

a mold body, a plurality of mold cavities defined in the mold body, each mold cavity of the plurality of mold cavities extending between a floor and an opening along a longitudinal axis, each mold cavity of the plurality of mold cavities enclosed by at least one sidewall between the floor and the opening, the longitudinal axis of each mold cavity oriented generally along the vertical direction;

a plurality of ejector pads in the plurality of mold cavities, each ejector pad of the plurality of ejector pads movable between a low position and a high position;

a heater in thermal communication with the floor of each mold cavity of the plurality of mold cavities, the heater configured to maintain water within a lower portion of each mold cavity in a liquid state; and a drain conduit in fluid communication with the lower portions of the mold cavities and configured to receive the water in the liquid state from the lower portions of the mold cavities;

wherein the mold body comprises a plurality of passages, each passage of the plurality of passages extending between the lower portion of a respective one of the mold cavities and the drain conduit, and wherein each ejector pad obstructs the corresponding passage of the plurality of passages when in the low position, and wherein each ejector pad is spaced apart from the corresponding passage of the plurality of passages when in the high position.

8. The refrigerator appliance of claim 7, wherein the drain conduit is further in fluid communication with a drain pan and the drain conduit is configured to direct the received flow of liquid water from the mold cavities to the drain pan.

9. The refrigerator appliance of claim 7, wherein the drain conduit is further in fluid communication with a recirculation assembly, the recirculation assembly comprising a recirculation pump and a filter downstream from the recirculation pump and upstream of the mold cavities, and wherein the recirculation pump is configured to urge liquid water from the drain conduit to the mold cavities via the filter.

10. The refrigerator appliance of claim 7, wherein the drain conduit is further in fluid communication with an auxiliary ice maker.

11. The refrigerator appliance of claim 7, wherein the drain conduit is further in fluid communication with a sump and the drain conduit is configured to direct the received flow of liquid water from the mold cavities to the sump.

12. A method of making clear ice in a refrigerator appliance, the refrigerator appliance comprising a cabinet defining a chilled chamber, the method comprising:

filling a plurality of mold cavities in a mold body of an ice maker with liquid water;

directing a flow of chilled air from the chilled chamber of the refrigerator towards openings of the plurality of mold cavities, whereby the liquid water in an upper portion of each of the plurality of mold cavities freezes from the top down, whereby clear ice barrels are formed;

activating a heater in the mold body of the ice maker during the step of directing the flow of chilled air, the heater in thermal communication with a floor of each mold cavity of the plurality of mold cavities, whereby the liquid water in a lower portion of each of the plurality of mold cavities is maintained in a liquid state;

harvesting the clear ice barrels by moving an ejector pad in each of the mold cavities from a low position to a high position, wherein each ejector pad obstructs a drain passage in each of the mold cavities in the low position and wherein moving the ejector pad in each of the mold cavities to the high position comprises moving each ejector pad way from the corresponding drain passage; and draining at least a portion of the liquid water from the lower portions of the mold cavities with a drain conduit when the ejector pad in each of the mold cavities moves away from each drain passage during the step of harvesting.

13. The method of claim 12, wherein the step of filling the plurality of mold cavities comprises overflowing the mold cavities, whereby the water maintained in the liquid state in the lower portion of each mold cavity is diluted, and wherein the step of draining at least a portion of the liquid water comprises draining the overflow.

14. The method of claim 12, wherein the step of draining at least the portion of the liquid water comprises opening a valve in fluid communication with the lower portions of the mold cavities.

* * * * *